US005099563A

United States Patent [19]

Strusch

[11] Patent Number: 5,099,563

[45] Date of Patent: Mar. 31, 1992

[54] DEVICE FOR TIMING THE VALVES OF AN INTERNAL COMBUSTION ENGINE WHOSE CAMSHAFT IS DRIVEN BY A TOOTHED BELT, A CHAIN, OR A GEAR TRAIN

[75] Inventor: Wolfgang Strusch, Cologne, Fed. Rep. of Germany

[73] Assignee: Kloeckner-Humboldt-Deutz AG, Cologne, Fed. Rep. of Germany

[21] Appl. No.: 407,101

[22] Filed: Sep. 14, 1989

[51] Int. Cl.[5] ..... B23P 13/00

[52] U.S. Cl. ..... 29/281.5

[58] Field of Search ..... 73/116; 123/90.1; 81/484; 29/888.08, 888.1, 281.5, 271, 888.42; 411/386, 401, 408, 400

[56] References Cited

U.S. PATENT DOCUMENTS

| | | | |
|---|---|---|---|
| 4,232,497 | 11/1980 | Meschnig | 411/386 |
| 4,461,062 | 7/1984 | Melzer et al. | 81/484 |
| 4,753,454 | 6/1988 | Woehler et al. | 81/484 |
| 4,796,494 | 1/1989 | Eckenrode et al. | 81/484 |
| 4,957,317 | 9/1990 | Jakubas | 411/402 |

*Primary Examiner*—Robert C. Watson
*Attorney, Agent, or Firm*—Charles L. Schwab

[57] ABSTRACT

A device for timing the valves on an internal combustion engine wherein the camshaft operating the valves is driven by the crankshaft through a suitable power transmitting mechanism such as a gear train, a toothed belt or a chain belt. The crankshaft and the camshaft are brought into predetermined positions independent of each other and held against rotation by positioning parts. The power transmitting mechanism is tightly attached to the shaft journals and then the positioning parts are removed.

15 Claims, 2 Drawing Sheets

DEVICE FOR TIMING THE VALVES OF AN INTERNAL COMBUSTION ENGINE WHOSE CAMSHAFT IS DRIVEN BY A TOOTHED BELT, A CHAIN, OR A GEAR TRAIN

TECHNICAL FIELD

This invention relates to a device for timing the valves of an internal combustion engine.

PRIOR ART STATEMENT

In internal combustion engines, maintenance of the exact timing of the intake and exhaust valves, as well as exact adjustment of the injection pump, is an important prerequisite for the flawless functioning of the engine. Improper timing in newly manufactured engines or in repaired engines impairs engine performance and can result in damage to the driving gear.

European patent publication EP-A-01 24 433 shows a control housing with a chain drive and a device by which the position of the camshaft may be synchronized with the crankshaft in any position of the latter. The housing contains, in pre-mounted position, the driving and driven gears as well as the chain that engages the gears and thus determines the pre-adjustment of the control, so that the injection pump shaft and the camshaft are coupled with the respective gears in their desired position relative to the crankshaft. The gears, freely arranged in the housing, are held in their position by arc shaped fins adapted to the contour of said gears. The housing further contains detachable angle-shaped positioning parts, which have protruding cylindrical elevations with fins, and which cooperate with the gears and the partial grooves of each in angular gear positions to be fixed.

The assembly of the beforementioned control housing is complicated and the housing must be opened for any readjustment. Incorrect adjustments of the detachable positioning parts are possible and such may occur every time the parts are installed and removed thereby impairing the desired exact adjustment of the driving and driven shafts relative to each other. Furthermore, the control box must be resealed after every removal or adjustment.

OBJECTS AND BRIEF SUMMARY OF THE INVENTION

It is a primary object of the invention to provide a device for timing the valves of an internal combustion engine, which is easy to operate and satisfies the requirement of exact positioning of the driving crankshaft and the driven camshaft during adjustment operations.

In carrying out the present invention, the camshaft and the crankshaft are each held immovably in a well-defined position by an adjusting pin. The crankshaft is held in its position by an adjusting pin screwed into the crankcase and by a stop sleeve. The camshaft, which has a much smaller mass, is held in a predetermined position by an adjusting pin that is screwed into an opening through the crankcase, or through an opening in a housing especially provided for the camshaft, and extends into a hole provided in the camshaft for the adjusting pin.

The tips of the adjusting pins extend smoothly into the respective holes of the camshaft and crankshaft, but without play, in order to prevent any rotary motion of the shafts.

In order to more securely hold the shafts against rotation, the tips of the adjusting pins and the associated holes of the camshaft and crankshaft may be threaded for a firm interconnection of the parts.

Macroscopic movement of the shafts may be prevented by magnetic activation of the tips of the adjusting pins, whereby a maximum degree of precision of adjustment can be achieved.

The part of the adjusting pin lying inside the crankshaft is advantageously reduced in diameter at the camshaft, and the stop sleeve at the crankshaft is also of a reduced diameter. Each adjusting pin includes a stepped diameter part which is threaded and screwed tightly into a threaded hole in the crankcase. In both adjusting pin installations, a stepped end face or shoulder of the adjusting pin abuts the crankcase and holds the respective adjusting pin firm against tilting movement. The end part of the stop sleeve in the installed condition additionally abuts a flattened surface on the crankshaft, thus affording additional structure for preventing rotation of the crankshaft.

The threaded parts of the crankcase and adjusting pin are designed so that the threaded openings in the crankcase are flush with the exterior contours of the crankcase and the exterior abutment surface surrounding the threaded openings in the crankcase is disposed in a right angle relationship to the axis of the adjusting pin.

BRIEF DESCRIPTION OF THE DRAWINGS

Preferred embodiments of the invention are illustrated in the drawings, in which.

DETAILED DESCRIPTION OF THE DRAWINGS

Figure 1A:
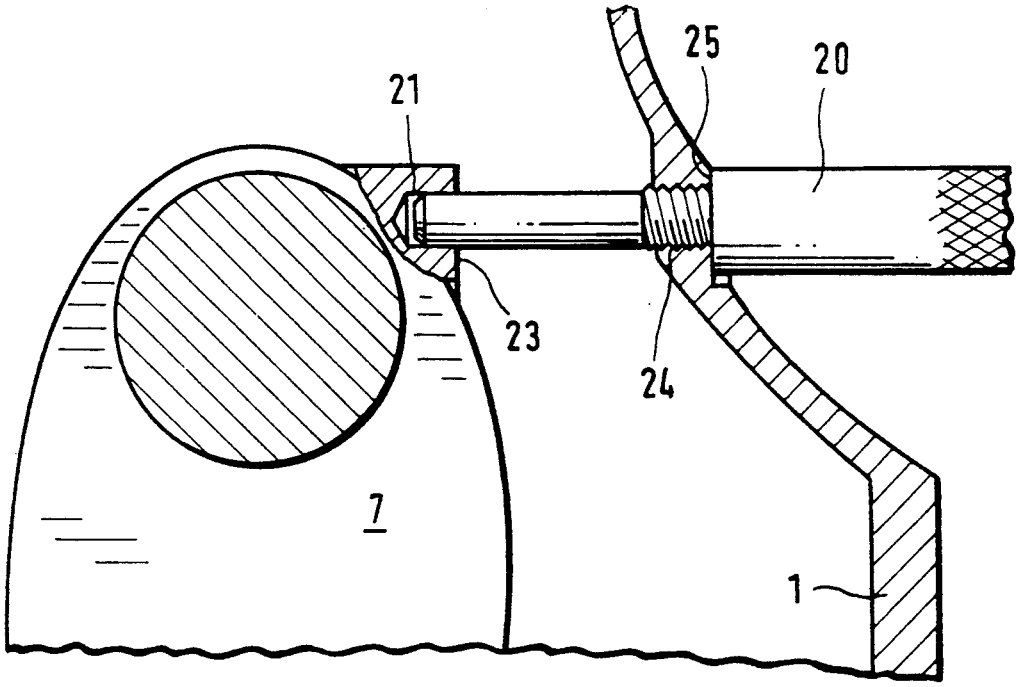
FIGS. 1*a* and 1*b* are sections through a crankshaft showing an adjusting pin engaging a hole with no play in version "a" and with play in version "b" and FIG. 2 is a section through the crankcase of an internal combustion engine, with parts broken away for illustration purposes, showing the camshaft and the crankshaft restrained against rotary movement.

FIG. 1 "a" shows an axial section of a crankcase 1 in which a crankshaft 7 is mounted by bearings, not shown, for rotation about the axis of the crankshaft. Laterally on a crank cheek a stop surface 23 is provided in which a hole 21 is drilled at right angles thereto. The hole 21 is in axial alignment with a tapped hole 24 in the crankcase 1. The axis of the hole 21 is spaced above the axis of the crankshaft and the axis of the drilled and tapped hole 24 lies in a horizontal plane parallel to and spaced above a horizontal plane through the axis of the crankshaft 7. An adjusting pin 20 is screwed into the tapped hole 24 of the crankcase 1 until its axially facing shoulder surface 25 abuts the complimentary seating surface on the exterior of the crankcase and its tip extends axially into and engages with the cylindrical surface defining the hole 21. Thus the crankshaft can be held in the desired timing position. The outer part of the adjusting pin is knurled in order to facilitate installation and removal of said adjusting pin.

Figure 1B:
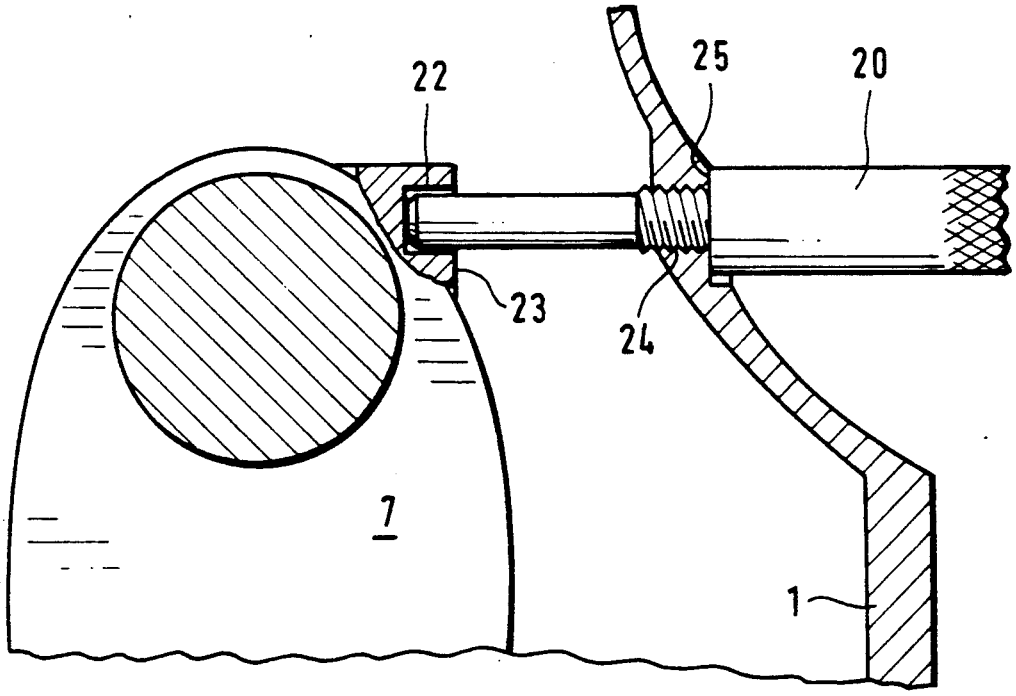

The embodiment of FIG. 1*b* differs from that of FIG. 1*a* in that the hole 22, with which the adjusting pin 20 engages, has more play than does the hole 21; this embodiment is easier to use and more economical to manufacture.

Figure 2:
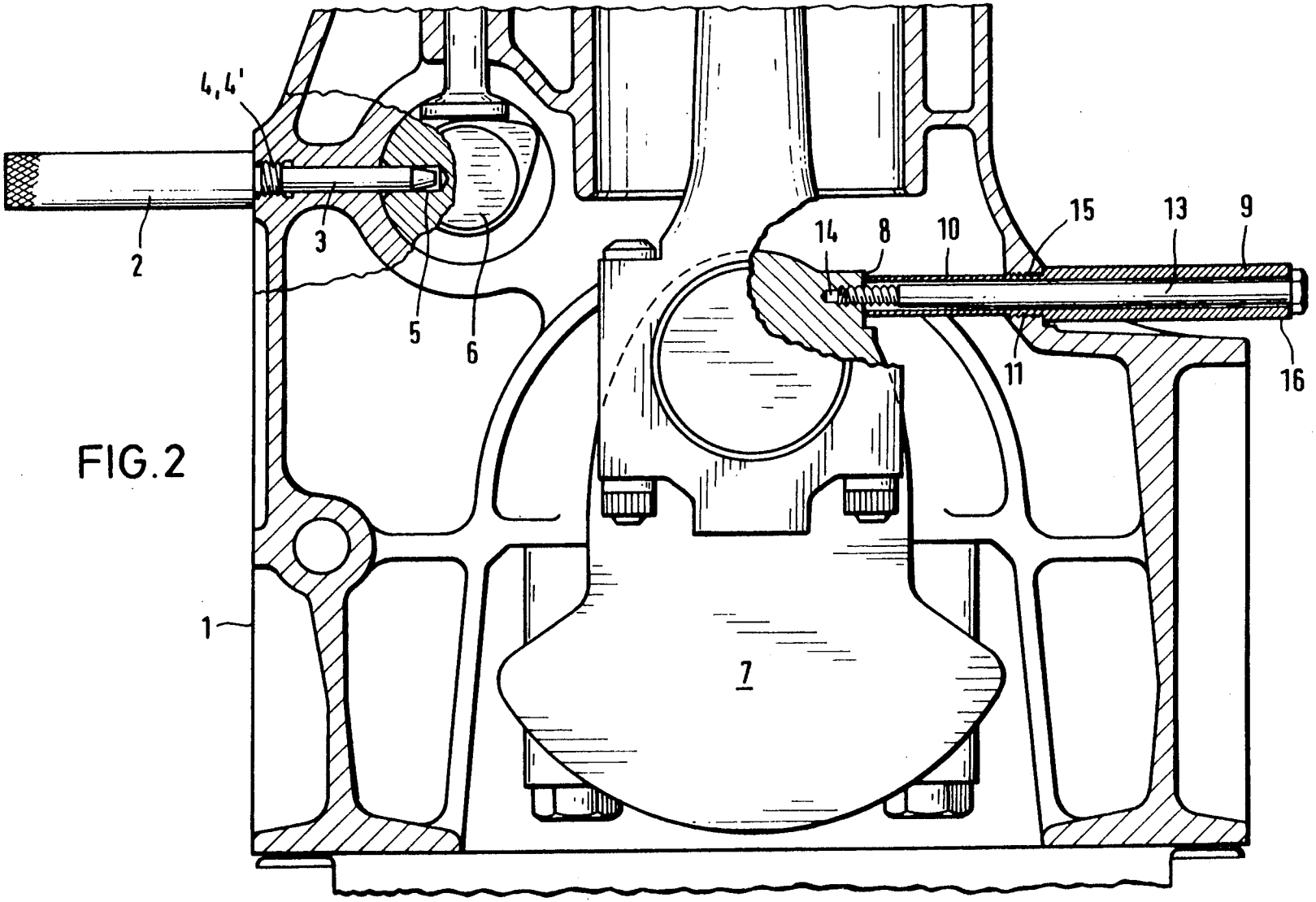

FIG. 2 shows a crankcase 1 of an internal combustion engine in which a camshaft 6 and the crankshaft 7 are rotatably mounted. At the elevation of the camshaft, a hole 4 is drilled in the crankcase in alignment with the axis of the camshaft 6. The laterally outer end part 4' of the hole 4 is internally threaded. The camshaft 6 has a drilled cylindrical hole 5, which is in alignment with the hole 4 when the camshaft 6 is brought into the proper position for timing the valves. The adjusting pin 2 is pushed through the two holes 4, 5 aligning with each other and is screwed tight to the threaded part 4'. The cylindrical outer surface of the reduced diameter stepped part 3 of the adjusting pin 2 engages the interior cylindrical surface of the hole 5 and holds the camshaft 6 immovably fixed in its timing position.

In the screwed-in condition, the cylindrical end of the adjusting pin engages snugly and without play in the camshaft hole 5 and restrains the camshaft 6 in the desired position for timing adjustment. Enhanced security against rotation is achieved by means of the contact of the shoulder of the adjusting pin with a complimentary surface on the outside of the crankcase. The adjusting pin 2 is knurled or provided with a hexagonal head or with a slot in order to facilitate the installation or the turning of this part in the threaded opening of the crankcase.

Further, at the elevation of the upper part of the crankshaft 7, spaced above a horizontal plane through the axis of the crankshaft a drilled and tapped hole is provided in the crankcase 1 on an axis parallel the horizontal plane through the axis of the crankshaft. A reduced diameter threaded part 11 of a stop sleeve 9 is screwed into the drilled and tapped hole. The threaded part 11 is at the laterally inner end of the stop sleeve 9 and the shoulder between the threaded part and the larger diameter knurled part 16 abuts a complimentary flat exterior surface on the outside wall of the crankcase when the stop sleeve is installed and at the same time the end of a sleeve part 10 abuts the flat surface 8 surrounding a tapped hole 14 in the crankshaft 7. With this device, the highest degree of security against rotation is achieved.

The stop sleeve 9 has a concentric cylindrical passage through which an adjusting pin bolt 13 is inserted smoothly but without play, the threaded tip of said adjusting pin bolt is screwed into the tapped hole 14 confronting it in the crankshaft and, together with the stop sleeve 9 and sleeve part 10, holding the crankshaft immovably in its position.

If required, any macroscopic movement occurring because of the weight of the crankshaft can be eliminated by magnetic activation of the tip of the adjusting pin13 inside the tapped hole 14. The adjusting sleeve part 16 is knurled or provided with a hexagonal exterior in order to facilitate installation.

By means of the two adjusting pins, the driving crankshaft and the driven camshaft are placed in immovable positions. The force-transmitting element, chain or gear drive, can then be fastened to the immovably fixed shafts.

With this precision method of timing, pin holes in the gears as well as any marking on the gears become unnecessary. Similarly, multiple piston or distributor-type injection pumps can also be adjusted in an error-free manner with firm securing of the components in their predetermining timing positions.

Upon completion of the adjustment and installation operations, the stop pins are removed and the holes in the crankcase are closed with threaded plugs.

What is claimed is:

1. In an internal combustion engine having a crankcase structure, (1) a cylinder head structure, a crankshaft rotatably mounted on said crankcase structure, a camshaft rotatably mounted on one of said structures, said camshaft being driven by the crankshaft, a device for timing valves comprising: a crankshaft adjusting pin mounted on said crankcase structure including a stop sleeve (9) abutting said crankcase structure and an adjusting pin bolt extending through said stop sleeve and engaging said crankshaft (7) and a camshaft adjusting pin mounted on said one structure and having an end in locking engagement with said camshaft, whereby said camshaft (6) and crankshaft (7) are maintained in predetermined timing positions.

2. The combination of claim 1 wherein said camshaft and said crankshaft have holes and wherein said adjusting pins (2, 13) have tips which snugly engage said holes (5, 14) respectively, when said camshaft (6) and crankshaft (7) are in predetermined timing positions.

3. A combination of claim 2 wherein one of said holes and its associated adjusting pin are threaded for threaded engagement during a timing adjustment.

4. The combination of claim 3 wherein said crankcase structure includes a threaded opening and one of said adjusting pins includes a threaded portion in threaded engagement with said threaded opening in said crankcase structure.

5. The combination of claim 1 wherein the tips of at least one of said adjusting pins is magnetic.

6. The combination of claim 1 wherein said crankcase structure includes a pair of threaded openings and said adjusting pins include threaded portions in threaded engagement with said threaded openings, respectively.

7. The combination of claim 6 and further comprising flat abutment surfaces on said crankcase structure adjacent to and surrounding said holes and annular shoulders on said adjusting pins presenting abutment surfaces in abutting engagement, respectively, with said abutment surfaces on said crankcase structure when said adjusting pins are installed to maintain said camshaft and crankshaft in their timing positions.

8. The combination of claim 1 wherein said crankshaft includes a threaded opening and wherein said crankshaft adjusting pin includes a threaded end threadedly engaging said threaded opening whereby said crankshaft is maintained in its timing position.

9. The combination of claim 8 wherein said crankcase structure has a threaded opening and said crankcase adjusting pin has a threaded intermediate portion in threaded engagement with said threaded opening in said crankcase.

10. The combination of claim 9 wherein said crankshaft adjusting pin includes a bolt presenting said threaded end and a shank portion extending outwardly from said crankcase structure, a stop sleeve on said shank portion in abutment with said crankcase structure and presenting said threaded intermediate portion.

11. The combination of claim 10 wherein said crankshaft adjusting pin includes a sleeve part surrounding said bolt and disposed between said threaded intermediate portion and said crankshaft.

12. In an internal combustion engine of the type having a head structure, a crankcase structure, a crankshaft rotatably mounted in said crankcase structure and a camshaft mounted in one of said structures and rotatably driven by said crankshaft, a device for timing the valves of said engine comprising:

a first threaded opening formed in said crankcase structure, a threaded hole in said crankshaft;

a first sleeve part having an end in the threaded engagement with said first threaded opening in said crankcase structure, a second sleeve part extending between said threaded end of said first sleeve part and said crankshaft, a crankshaft adjusting pin bolt extending through said sleeve parts and having a threaded end which is in threaded engagement with said threaded hole in said crankshaft in the installed position of said crankshaft adjusting pin bolt, a second threaded opening in one of said structures, a radial hole in said camshaft, and a camshaft adjusting pin having a threaded part in threaded engagement with said threaded opening in said one structure and an end extending into and in snug fitting relation with said radial hole in said camshaft when said camshaft adjusting pin is in its installed position, said pins in their installed positions maintaining said crankshaft and camshaft in predetermined valve timing positions.

13. The combination of claim 12 wherein said crankcase includes a flat abutment surface adjacent to and surrounding said hole in said crankcase and wherein said crankshaft adjusting pin includes an annular shoulder presenting an abutment surface in abutment with said flat abutment surface on said crankcase structure.

14. The combination of claim 13 wherein said abutment surface on said crankcase structure is generally flush with the adjacent exterior contour of the crankcase structure.

15. An internal combustion engine comprising:

a crankcase structure, a cylinder head structure, a crankshaft (7) supported on said crankcase structure for rotation on a first axis, a camshaft (6) supported on a second axis on one of said structures and driven by said crankshaft, and a device for timing the valves of said engine including a first threaded opening formed in said crankcase structure on an axis spaced from the axis of said crankshaft, a crankshaft adjusting pin having a threaded part and an end, said crankshaft adjusting pin having an installed position in which said threaded part is in threaded engagement with said first threaded opening and said end extends into said crankcase structure and engages said crankshaft at a point thereon spaced from a horizontal plane through the axis of said crankshaft, a second threaded opening formed in one of said structures on an axis intersecting the axis of said camshaft, a radial hole drilled in said camshaft which aligns with said second threaded opening when said camshaft is in a predetermined position for timing said valves, and a threaded camshaft adjusting pin with an end, said camshaft adjusting pin having an installed position in which said pin is in threaded engagement with said second threaded opening and said end extends into and in complimentary snug fitting relation with said radial hole in said camshaft.

said crankshaft and camshaft being held in predetermined valve timing positions when said pins are in their installed positions.

* * * * *

UNITED STATES PATENT AND TRADEMARK OFFICE

CERTIFICATE OF CORRECTION

PATENT NO. : 5,099,563

DATED : Mar. 31, 1992

INVENTOR(S) : Wolfgang Strusch

It is certified that error appears in the above-identified patent and that said Letters Patent is hereby corrected as shown below:

Column 5, line 26, following "case" insert --- structure ---;

Column 5, line 27, following "crankcase" insert --- structure ---.

Signed and Sealed this

Twenty-first Day of September, 1993

Bruce Lehman

*Attest:*

BRUCE LEHMAN

*Attesting Officer*

*Commissioner of Patents and Trademarks*